US012235074B2

(12) United States Patent
Teetzel et al.

(10) Patent No.: US 12,235,074 B2
(45) Date of Patent: Feb. 25, 2025

(54) GRENADE LAUNCHER WITH INTEGRAL FIRE CONTROL SYSTEM

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 111 days.

(21) Appl. No.: 18/199,106

(22) Filed: May 18, 2023

(65) Prior Publication Data

US 2024/0085149 A1 Mar. 14, 2024

Related U.S. Application Data

(60) Provisional application No. 63/343,617, filed on May 19, 2022.

(51) Int. Cl.
*F41G 1/30* (2006.01)
*F41F 1/00* (2006.01)

(52) U.S. Cl.
CPC . *F41G 1/30* (2013.01); *F41F 1/00* (2013.01)

(58) Field of Classification Search
CPC ... F41G 1/473; F41G 1/30; F41G 1/48; F41G 1/52; F41G 3/06; G06G 7/80; F41F 1/00; F41C 7/11; F41C 27/06
USPC ..... 235/418, 404; 42/138, 135, 105, 75.04, 42/8, 75.02, 12, 13, 26, 27, 32
See application file for complete search history.

(56) References Cited

U.S. PATENT DOCUMENTS

| | | | | |
|---|---|---|---|---|
| 5,555,662 | A | 9/1996 | Teetzel | |
| 5,669,174 | A | 9/1997 | Teetzel | |
| 6,568,118 | B1 * | 5/2003 | Teetzel | F41G 3/06 42/105 |
| 8,047,118 | B1 | 11/2011 | Teetzel et al. | |
| 8,100,044 | B1 | 1/2012 | Teetzel et al. | |
| 8,505,434 | B2 * | 8/2013 | Wieland | F41G 1/473 42/105 |
| 8,561,518 | B2 | 10/2013 | Teetzel et al. | |
| 8,978,539 | B2 | 3/2015 | Teetzel et al. | |
| 9,194,678 | B2 | 11/2015 | Teetzel et al. | |
| 9,506,723 | B2 * | 11/2016 | Teetzel | F41G 1/473 |
| 9,857,143 | B2 | 1/2018 | Teetzel et al. | |
| 10,066,903 | B2 * | 9/2018 | Crispin | F41G 11/003 |
| 10,578,396 | B2 | 3/2020 | Teetzel et al. | |
| 11,781,834 | B2 * | 10/2023 | Teetzel | F41G 3/165 42/105 |
| 2012/0043381 | A1 * | 2/2012 | Teetzel | F41G 1/473 235/404 |

(Continued)

*Primary Examiner* — John Cooper
(74) *Attorney, Agent, or Firm* — McLane Middleton, Professional Association

(57) ABSTRACT

A grenade launcher apparatus having an integral fire control system includes a receiver having a fore end portion, a pivotally attached to the fore end portion, the barrel having a muzzle end and a breech end. A trigger assembly is coupled to the receiver adjacent the breech end of the barrel and a hand grip is attached to the receiver adjacent the trigger assembly. A buttstock assembly is coupled to the receiver and a fire control system secured to the fore end portion of the receiver. In another aspect, a fire control system is provided. In yet another aspect, a method aiming a grenade launcher apparatus is provided.

14 Claims, 11 Drawing Sheets

(56) References Cited

U.S. PATENT DOCUMENTS

| | | | | |
|---|---|---|---|---|
| 2015/0041538 | A1 | 2/2015 | Teetzel et al. | |
| 2015/0247714 | A1 | 9/2015 | Teetzel et al. | |
| 2016/0010949 | A1* | 1/2016 | Teetzel | F41G 1/35<br>42/114 |
| 2016/0153744 | A1 | 6/2016 | Teetzel et al. | |
| 2017/0299330 | A1 | 10/2017 | Teetzel et al. | |
| 2018/0283828 | A1 | 10/2018 | Teetzel et al. | |
| 2022/0120533 | A1* | 4/2022 | Teetzel | F41G 1/473 |
| 2022/0128336 | A1* | 4/2022 | Sullivan | F41G 3/12 |

* cited by examiner

GRENADE LAUNCHER WITH INTEGRAL FIRE CONTROL SYSTEM

CROSS REFERENCE TO RELATED APPLICATION

This application claims the priority benefit of U.S. provisional Application No. 63/343,617 filed on May 19, 2022. The aforementioned application is incorporated herein by reference in its entirety.

BACKGROUND

The present invention relates to grenade launchers and, in particular, to an improved grenade launcher with an integrated fire control system.

SUMMARY

In one aspect, a grenade launcher apparatus comprises a receiver having a fore end portion and a barrel pivotally attached to the fore end portion, wherein the barrel has a muzzle end, a breech end, and a centerline extending therebetween. A trigger assembly is coupled to the receiver adjacent the breech end of the barrel and a hand grip is attached to the receiver adjacent the trigger assembly. A buttstock assembly is coupled to the receiver. A fire control system is secured to the fore end portion of the receiver and includes a first cradle arm and a second cradle arm opposing the first cradle arm, the first and second cradle arms attached to the fore end of the receiver on opposite transverse sides of the centerline. A main body comprises at least one sight for aiming the grenade launcher apparatus, the main body manually rotatably supported between the first and second cradle arms. The main body is pivotable about a pivot axis which extends perpendicular to the centerline. The fire control system further includes a processor assembly including a processor and an associated computer readable memory encoded with executable instructions, the processor configured, upon execution of the executable instructions, to determine a trajectory angle corresponding to a rotational position of the main body in relation to the centerline and to calculate a distance that a projectile fired by the grenade launcher apparatus will travel. A display is configured to output the distance in human viewable form, the distance configured to change responsive to manual rotation of the main body. The at least one sight is configured to assist the user in aligning the grenade launcher apparatus with the trajectory angle by causing the grenade launcher apparatus to be aligned with the trajectory angle when an optical axis of the at least one sight is aligned with a target located at the calculated distance.

In a more limited aspect, the fire control system permanently secured to the fore end portion of the receiver.

In another more limited aspect, the first cradle arm comprises a locking assembly. The locking assembly comprises a lock lever pivotable between an unlocked position wherein the main body is manually pivotable with respect to the first and second cradle arms and a locked position wherein the main body is prevented from pivoting with respect to the first and second cradle arms. A lock rotor is secured to the main body and aligned with the pivot axis. A lock plate is secured to the first cradle arm adjacent the lock rotor. An actuator has a cam surface engaging a cam follower on the lock plate. The actuator is attached to the lock lever, wherein pivoting movement of the lock lever causes pivoting movement of the actuator. The cam surface is configured to urge the lock plate into engagement with the lock rotor when the lock lever is moved into the locked position to thereby prevent pivoting movement of the main body with respect to the first and second cradle arms and to allow the lock plate to move out of engagement with the lock rotor when the lock lever is moved into the unlocked position to thereby allow pivoting movement of the main body with respect to the first and second cradle arms.

In another more limited aspect, the grenade launcher apparatus further comprises a ring clamp assembly pivotably securing the muzzle end of the barrel to the fore end of the receiver. The ring clamp assembly comprises a ring clamp having opposing first and second lugs and a threaded fastener securing the first and second lugs. A first hinge barrel is secured to the first lug, the first hinge barrel having a first bore. A second hinge barrel is secured to the fore end of the receiver, the second hinge barrel having a second bore aligned with the first bore. A barrel pivot pin is received in the first and second bores, such that the first and second hinge barrels and the barrel pivot pin cooperate to form a barrel pivot hinge for selectively pivoting the breech end of the barrel toward and away from the receiver.

In another more limited aspect, a fire control system for a projectile weapon comprises a first cradle arm and a second cradle arm opposing the first cradle arm, the first and second cradle arms configured for attachment to a weapon. A main body comprises at least one sight for aiming the grenade launcher apparatus and is manually rotatably supported between the first and second cradle arms. The main body is pivotable about a pivot axis which extends perpendicular to the centerline. A processor assembly includes a processor and an associated computer readable memory encoded with executable instructions and is configured, upon execution of the executable instructions, to determine a trajectory angle corresponding to a rotational position of the main body in relation to the centerline and calculate a distance that a projectile fired by the projectile weapon will travel. A display is configured to output the calculated distance in human viewable form, wherein the calculated distance is configured to change responsive to manual rotation of the main body. The at least one sight is configured to assist the user in aligning the grenade launcher apparatus with the trajectory angle by causing the grenade launcher apparatus to be aligned with the trajectory angle when an optical axis of the at least one sight is aligned with a target located the calculated distance. A locking assembly is disposed on the first cradle arm, the locking assembly comprising a lock lever pivotable between an unlocked position wherein the main body is manually pivotable with respect to the first and second cradle arms and a locked position wherein the main body is prevented from pivoting with respect to the first and second cradle arms. A lock rotor is secured to the main body and aligned with the pivot axis and a lock plate is secured to the first cradle arm adjacent the lock rotor. An actuator has a cam surface which engages a cam follower on the lock plate. The actuator is attached to the lock lever wherein pivoting movement of the lock lever causes pivoting movement of the actuator. The cam surface is configured to urge the lock plate into engagement with the lock rotor when the lock lever is moved into the locked position to thereby prevent pivoting movement of the main body with respect to the first and second cradle arms. The cam surface is further configured to allow the lock plate to move out of engagement with the lock rotor when the lock lever is moved into the unlocked position to thereby allow pivoting movement of the main body with respect to the first and second cradle arms.

In a further aspect, a method is provided for aligning a barrel of a grenade launcher with a trajectory angle in relation to a line of sight between the grenade launcher and a target so that the grenade launcher will launch a projectile a distance that corresponds to a distance to the target. A grenade launcher apparatus is provided, which comprises a receiver having a fore end portion; a barrel pivotally attached to the fore end portion, the barrel having a muzzle end, a breech end, and a centerline extending therebetween; a trigger assembly coupled to the receiver adjacent the breech end of the barrel; a hand grip attached to the receiver adjacent the trigger assembly; a buttstock assembly coupled to the receiver. A fire control system is provided that is secured to the fore end portion of the receiver, the fire control system comprising a first cradle arm and a second cradle arm opposing the first cradle arm, the first and second cradle arms attached to the fore end of the receiver on opposite transverse sides of the centerline. A main body comprises at least one sight for aiming the grenade launcher apparatus. The main body is manually rotatably supported between the first and second cradle arms and is pivotable about a pivot axis which extends perpendicular to the centerline. A processor assembly includes a processor and an associated computer readable memory encoded with executable instructions. The processor is configured, upon execution of the executable instructions, to determine a trajectory angle corresponding to a rotational position of the main body in relation to the centerline and calculate a distance that a projectile fired by the grenade launcher apparatus will travel. A display is configured to output the distance in human viewable form, the distance configured to change responsive to manual rotation of the main body. The at least one sight is configured to assist the user in aligning the grenade launcher apparatus with the trajectory angle by causing the grenade launcher apparatus to be aligned with the trajectory angle when an optical axis of the at least one sight is aligned with a target located the calculated distance. The main body is rotated about the pivot axis until the calculated distance output to the display is equal to a preselected target distance and the optical axis of the at least one sight is aligned with the target.

Certain advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
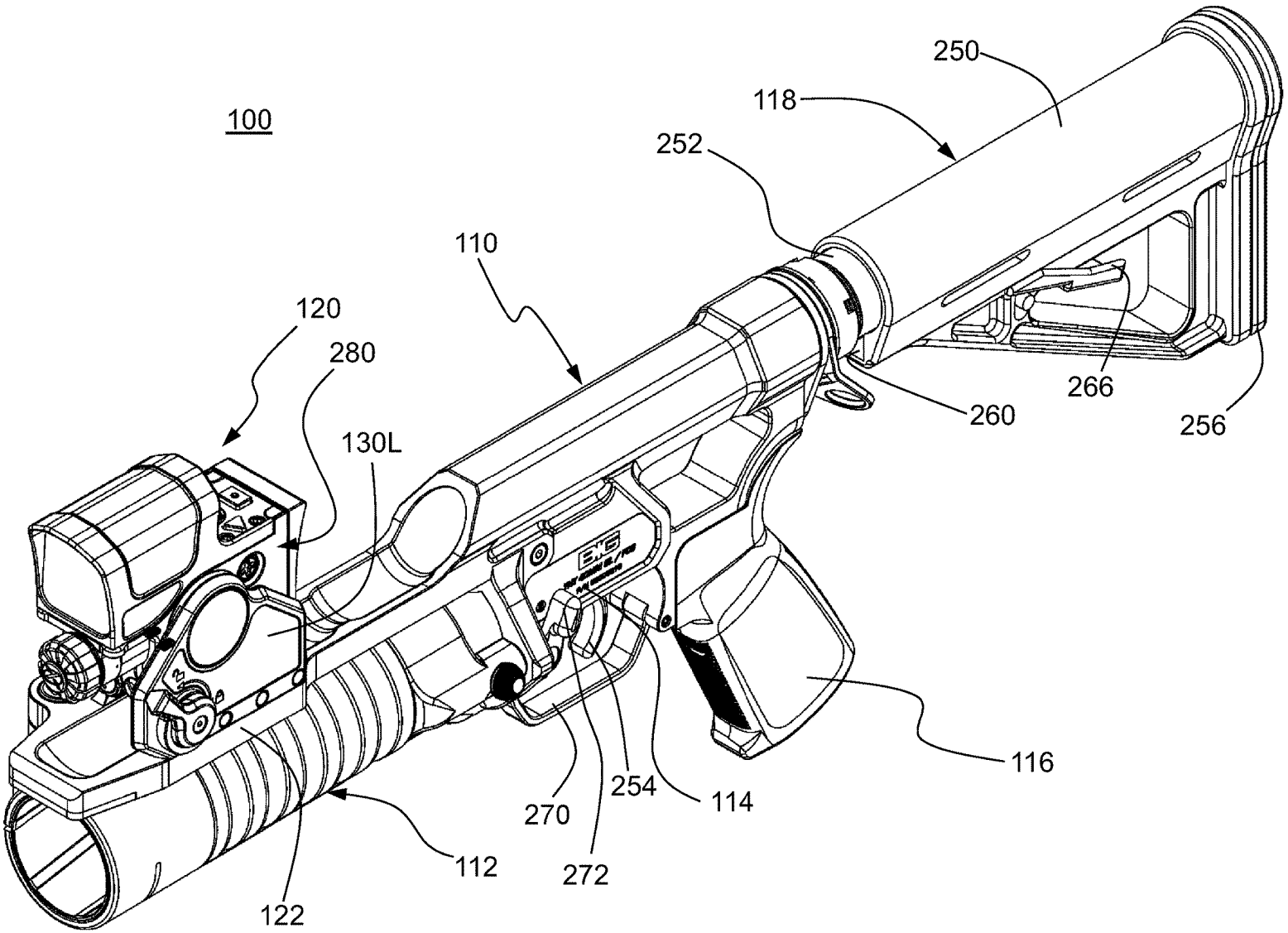
FIG. 1 is an isometric view of a grenade launcher apparatus in accordance with an exemplary embodiment of the invention, taken generally from above, the front, and the left side, with the shoulder stock in the collapsed position.
Figure 2:
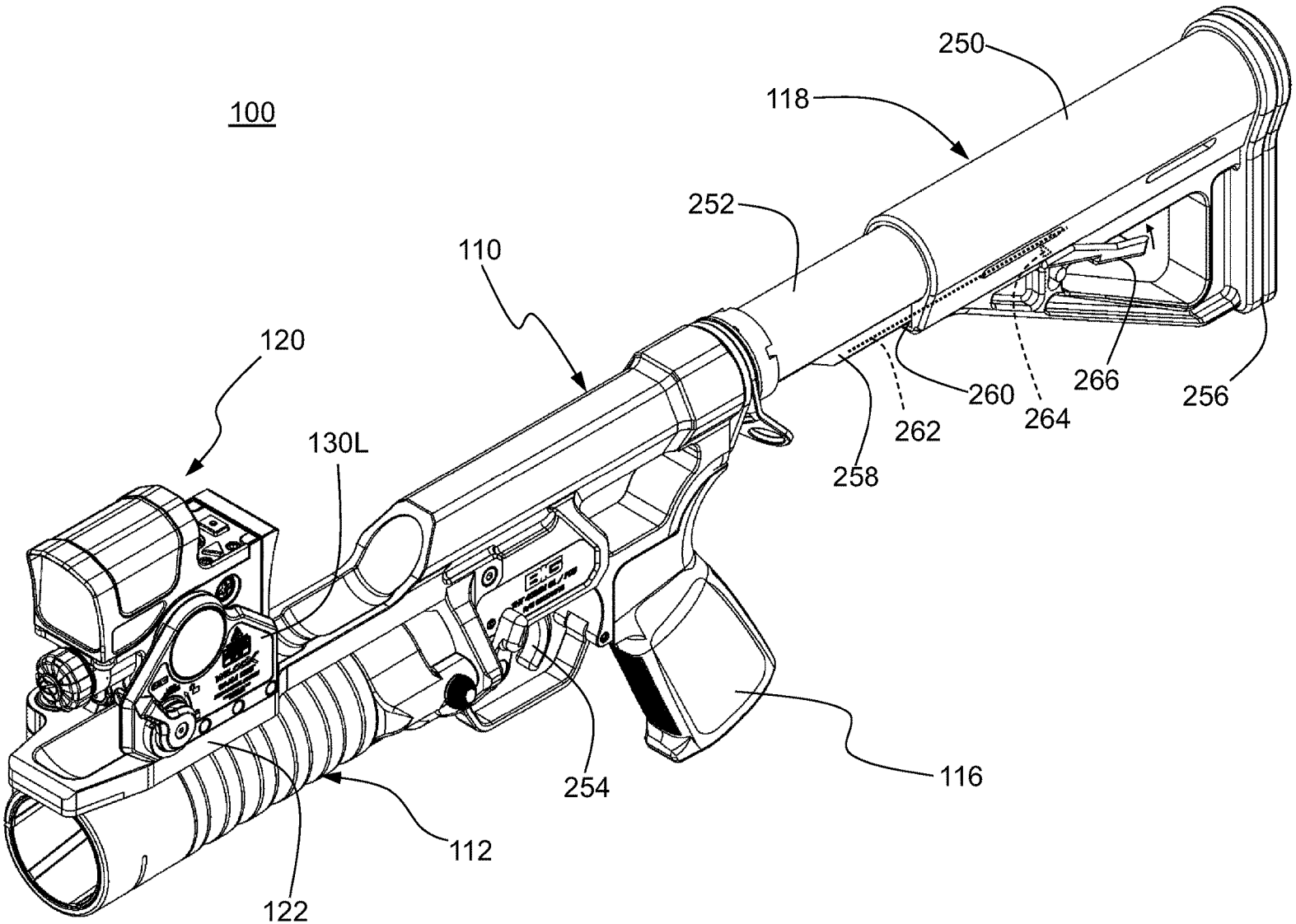
FIG. 2 is an isometric view of the grenade launcher apparatus appearing in FIG. 1, with the shoulder stock in the expended position.
Figure 3:
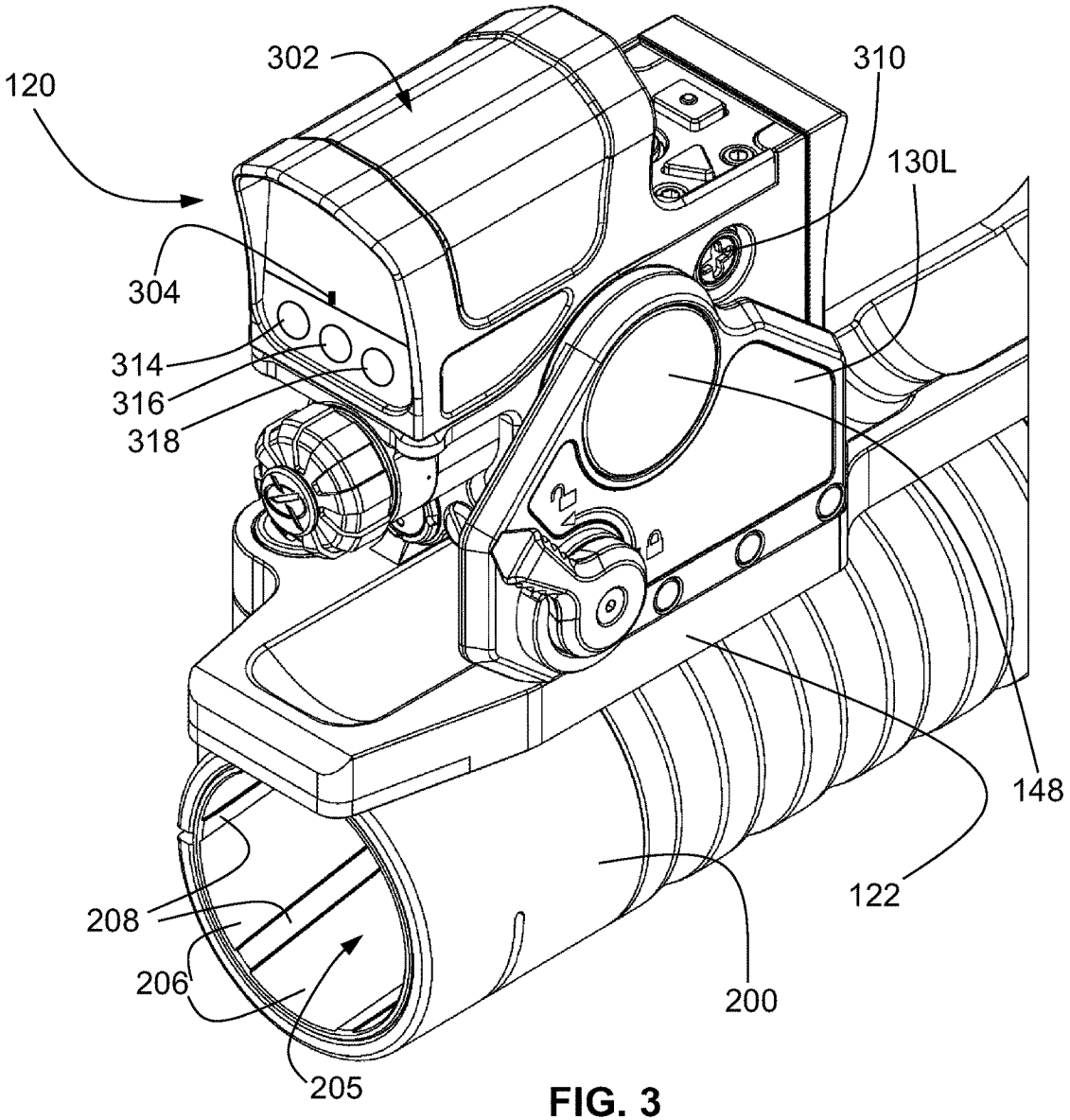
FIG. 3 is an enlarged, fragmentary, isometric view of the fore-end portion of the grenade launcher apparatus, taken generally from above, the front, and the left side.
Figure 4:
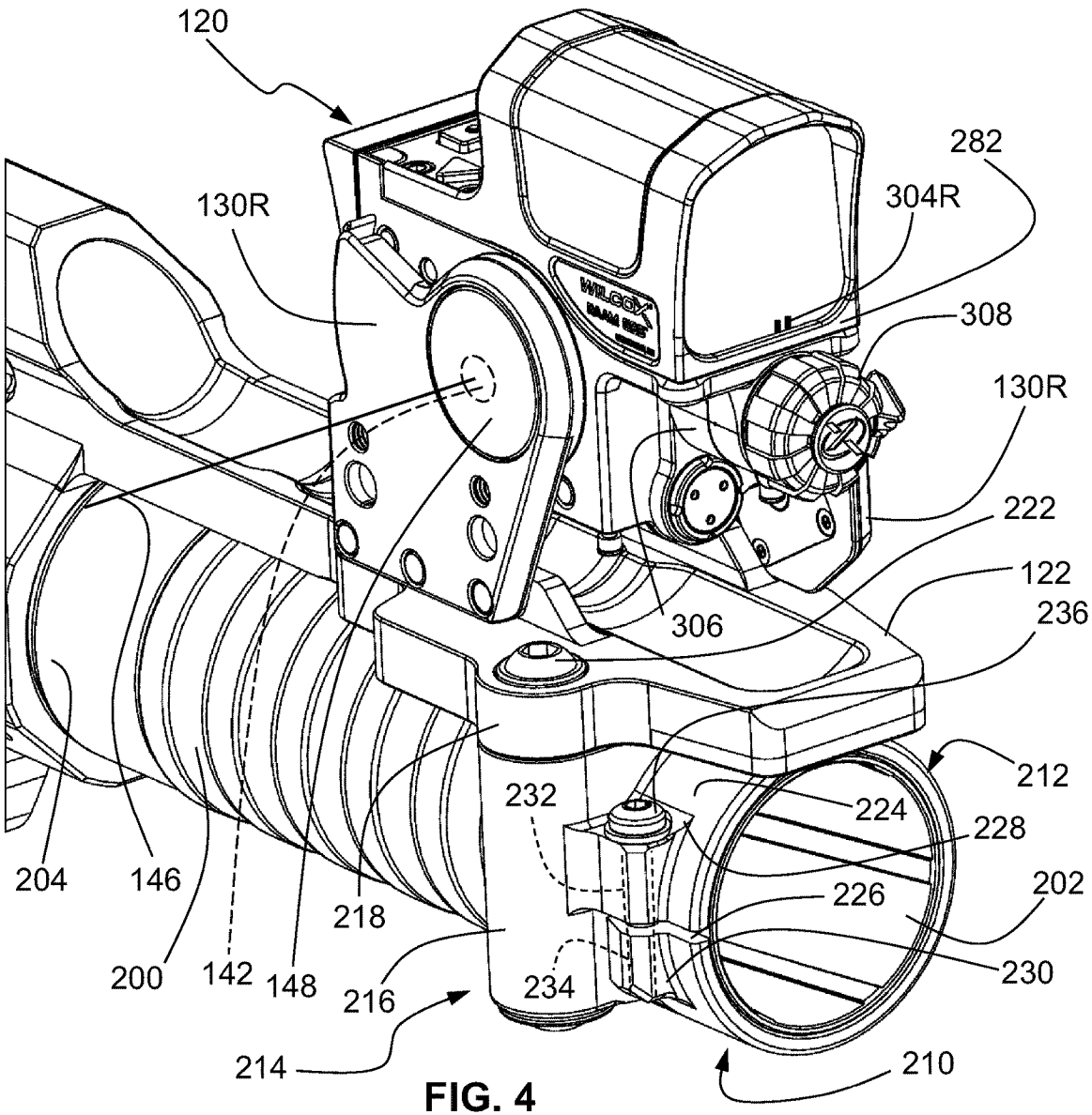
FIG. 4 is an enlarged, fragmentary, isometric view of the fore-end portion of the grenade launcher apparatus, taken generally from above, the front, and the right side.
Figure 5:
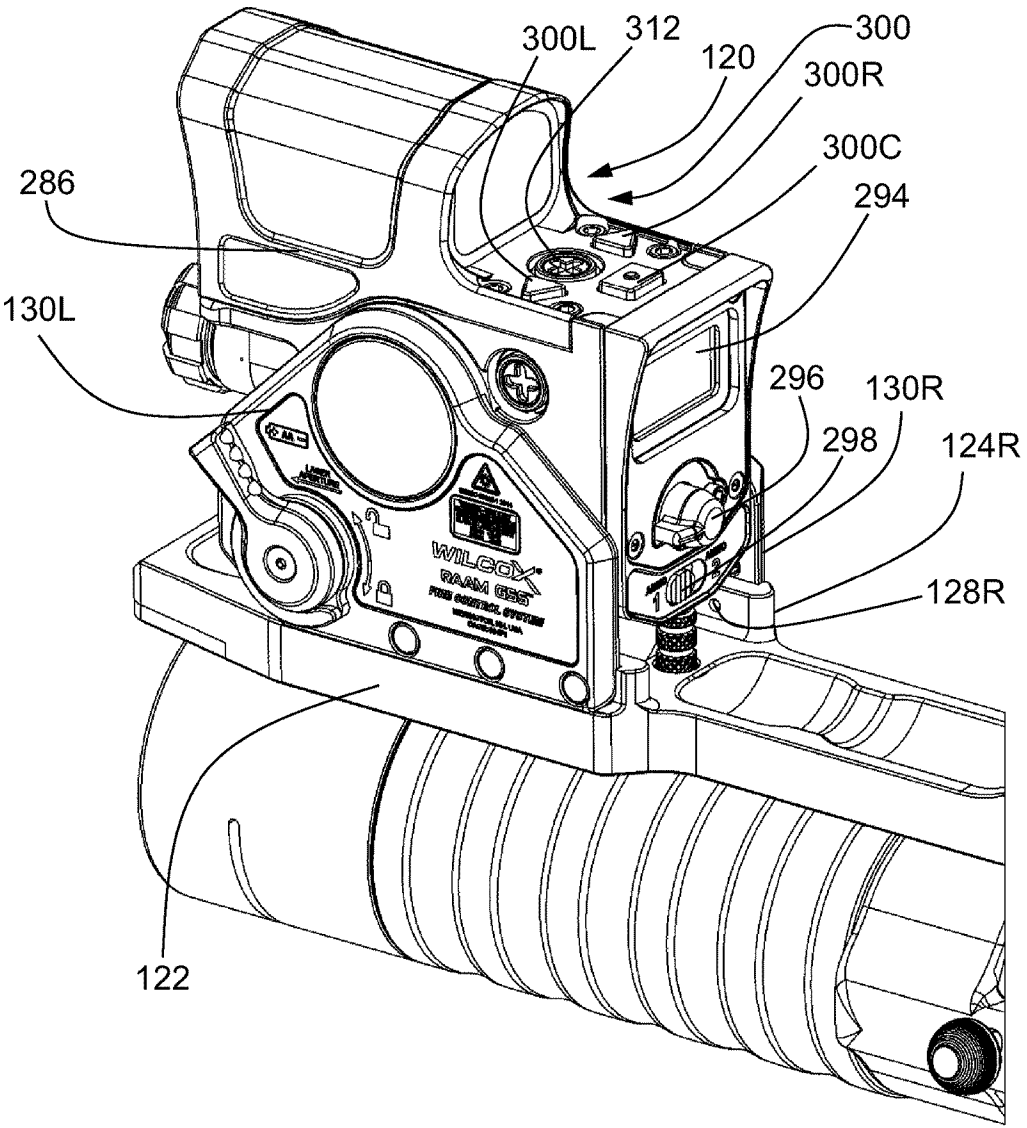
FIG. 5 is an enlarged, fragmentary, isometric view of the fore-end portion of the grenade launcher apparatus, taken generally from above, the rear, and the left side.
Figure 6:
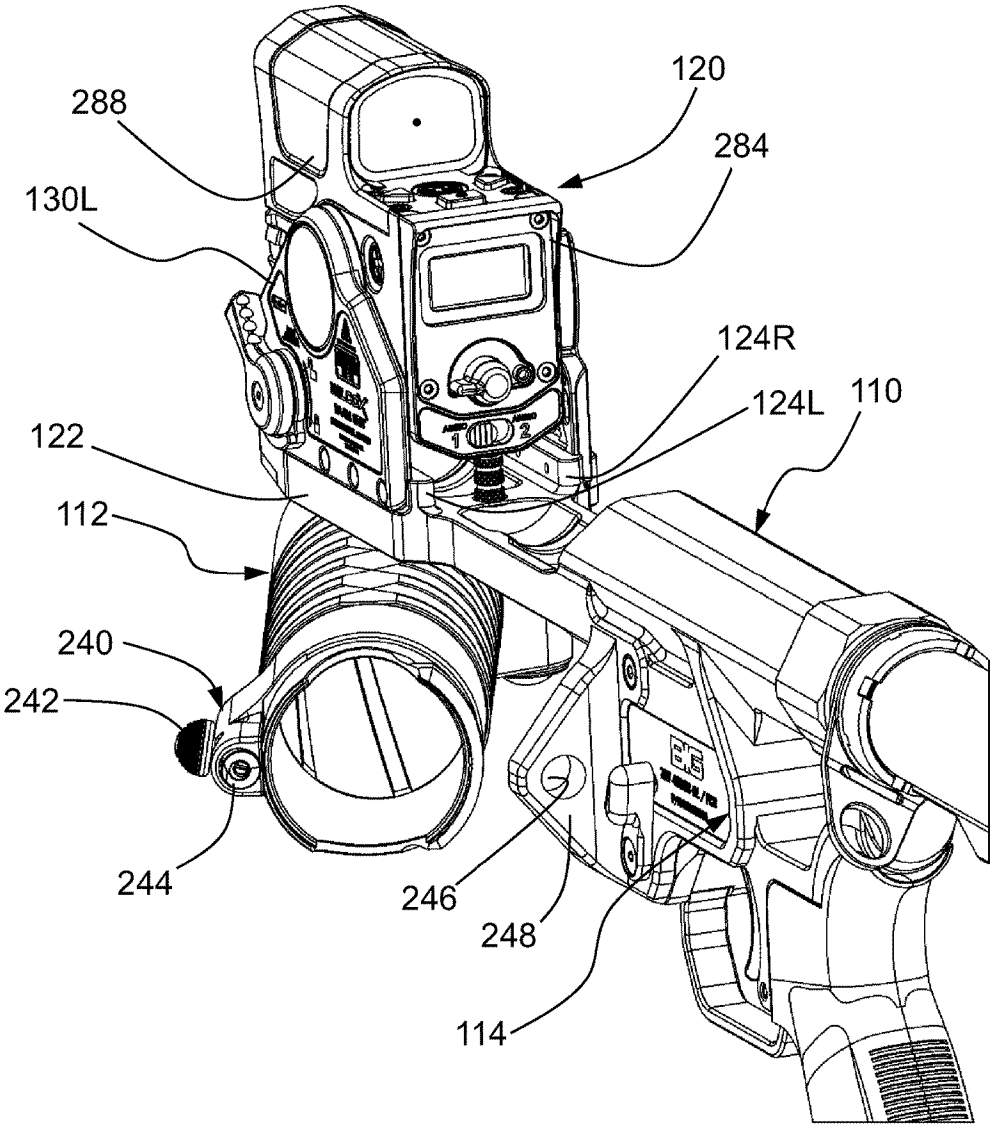
FIG. 6 is a fragmentary, isometric view of the grenade launcher apparatus, taken generally from the rear and the left side, with the grenade launcher barrel assembly pivoted to the breech-open position.
Figure 7:
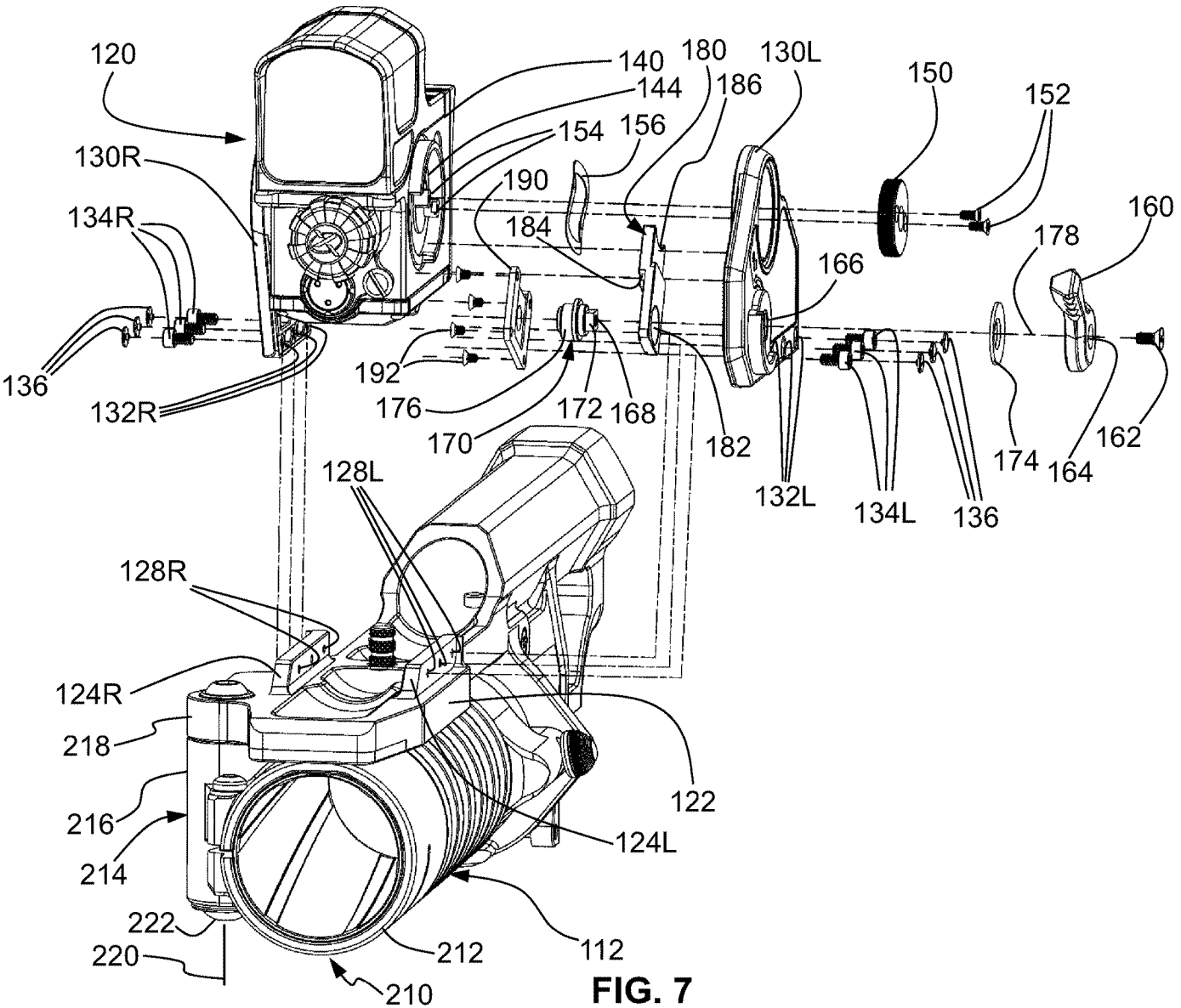
FIG. 7 is an isometric view of the receiver portion of the grenade launcher apparatus appearing in FIG. 1, taken generally from the front and right, with the fire control system fastener and pivot locking systems appearing in exploded view.
Figure 8:
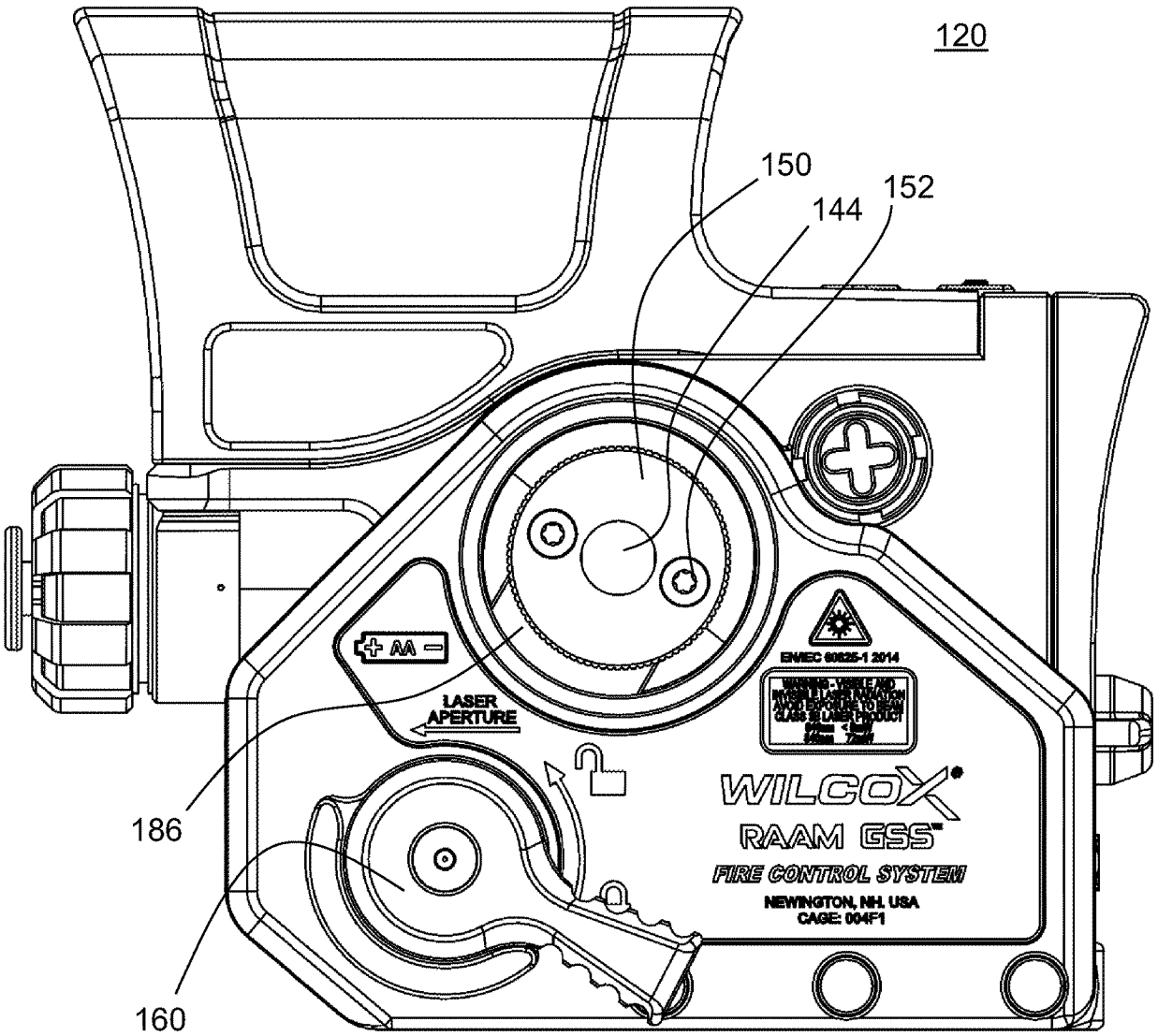
FIG. 8 is a left side elevational view of the fire control system appearing in FIG. 1, with the lock lever in the locked position.

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

Referring now to the drawing FIGS. 1-10, there is illustrate a grenade launcher apparatus designated generally as 100. The grenade launcher apparatus 100 includes a grenade launcher receiver portion 110, a grenade launcher barrel assembly 112, a grenade launcher trigger assembly 114, a pistol grip 116, a shoulder stock or buttstock assembly 118, and an integrated fire control system 120.

As used in this application, the terms "front," "rear," "upper," "lower," "upwardly," "downwardly," and other orientation descriptors are intended to facilitate the description of the exemplary embodiment(s) of the present invention, and are not intended to limit the structure thereof to any particular position or orientation.

The receiver portion 112 includes a mounting platform 122 configured to permanently secure the fire control system 120 at the fore end of the receiver 112. As used herein, the term "permanently attached" means that removal and reattachment are not easily or readily accomplished by a user, for example, not readily accomplished without the use of equipment similar to that needed for initial manufacture of the unit 100.

The platform 122 includes a pair of opposing, laterally spaced apart mounting rails 124L and 124R extending parallel to and on the left and rights sides, respectively of the longitudinal axis 126 of the barrel 112. A plurality of internally tapped openings 128L are axially spaced along the mounting rail 124L. A plurality of internally tapped openings 128R are axially spaced along the mounting rail 124R.

A right cradle support arm 130R is mounted to the mounting rail 124R and includes a plurality of clearance openings 132R aligned with the plurality of openings 128R. A threaded fastener 134R passes through each opening 132R and threadably engages an aligned one of the tapped openings 128R. A left cradle support arm 130L includes a plurality of clearance openings 132L aligned with the plurality of openings 128L. A threaded fastener 134L passes through each opening 132L and threadably engages an aligned one of the tapped openings 128L. Finishing caps 136 are disposed on the fasteners 134R, 134L to prevent removal of the threaded fasteners 134R, 134L from the respective mounting rails 124R, 124L.

The right and left cradle support arms 130R, 130L are disposed on transverse sides of a main body 140 of the integrated fire control system 120. The right cradle support arm 130R is pivotally attached to the right side of the main body 140 at a right pivot or hinge mechanism 142 and is pivotally attached to the left side of the main body 140 via a left hinge mechanism 144. The left cradle support arm 130L is pivotally or hingedly attached to the left side of the main body 140 at a left pivot point 144. The right pivot point 142, and left hinge 144 define a pivot axis 146 which extends transversely with respect to the pivot axis 126 of the barrel 112. A pivot cap 148 is disposed over each of the left and right hinge mechanisms.

A lock rotor 150 is disposed concentrically with respect to the pivot axis 146 and is secured to the left hinge 144 via a pair of threaded fasteners 152 that engage complementary protruding bosses 154 on the left hinge portion 144. A tensioning member such as a wave spring 156 is disposed intermediate the left hinge 144 and the lock rotor 150 to maintain a tension or load on the lock rotor and thereby reduce the risk of loosening of the threaded fasteners 152 securing the lock rotor 150, e.g., due to recoil, vibration, or other dynamic forces acting on the unit 100.

The lock rotor mounting bosses 154 run in arcuate openings 158 in the left cradle support arm 130L which act as stops to limit the range of rotation of the fire control system main body 140 to some preselected range. In embodiments, the range of rotation is 45 degrees from horizontal, although other ranges are contemplated.

A lock lever 160 is rotatably secured to an outward facing surface of the left cradle arm 130L via a threaded fastener 162 passing through an opening 164 in the lock lever 160. The fastener 162 passes through an opening 166 in the left cradle arm 130L and threadably engages a threaded opening 168 in a cammed post actuator 170. The cammed post actuator 170 includes a post 172 having a rectangular or other noncircular cross-sectional shape which engages a complementary shaped receptacle (not shown) formed on the inward facing side of the lock lever 160 to provide a keyed geometry to prevent rotational slippage between the lock lever 160 and the cammed post actuator 170. A disc spring tensioner 174 is disposed intermediate the lock lever 160 and the outward facing surface of the left cradle arm 130L to maintain a tension or load on the lock lever 160 to thereby reduce the risk of loosening of the threaded fasteners 162 securing the lock lever 160 to the cammed post actuator 170, e.g., due to recoil, vibration, or other dynamic forces acting on the unit 100.

The fastener 162, opening 164, and the opening 168 define a lever pivot axis 178. The cammed post actuator 170 includes an eccentrically cammed surface 176. In embodiments, the eccentrically cammed surface is a generally circular surface which is disposed slightly off center with respect to the lever pivot axis 178. A lock plate 180 is disposed intermediate the cam post actuator 170 and the inward facing surface of the left cradle arm 130L. The cam post actuator 170 passes through an opening 182 in the lock plate 180. The opening 182 is elongated in a direction corresponding to a direction of sliding or translational movement of the lock plate 170 in relation to the cam post actuator 170, in a direction toward or away from the lock rotor 150.

The eccentrically cammed surface 176 engages a shoulder/cam follower 184 on the lock plate 180. The lock plate also includes a distal end 186 which can brought into and out of engagement with the lock rotor 150. The lock lever 160 is pivotable about the axis 178 between an unlocked position wherein the main body 140 is manually pivotable about the fire control system pivot axis 146 to achieve a desired trajectory angle when the fire control system is aligned with a target, and, a locked position wherein the main body 140 is locked in position and not pivotable about the axis 146. A trap plate 190 secures the cammed post actuator 170 and the lock plate 180 in the operable position on the inward facing side of the left cradle arm 130L. The trap plate is secured to the inward facing side of the left cradle arm 130L via threaded fasteners 192.

Figure 9:
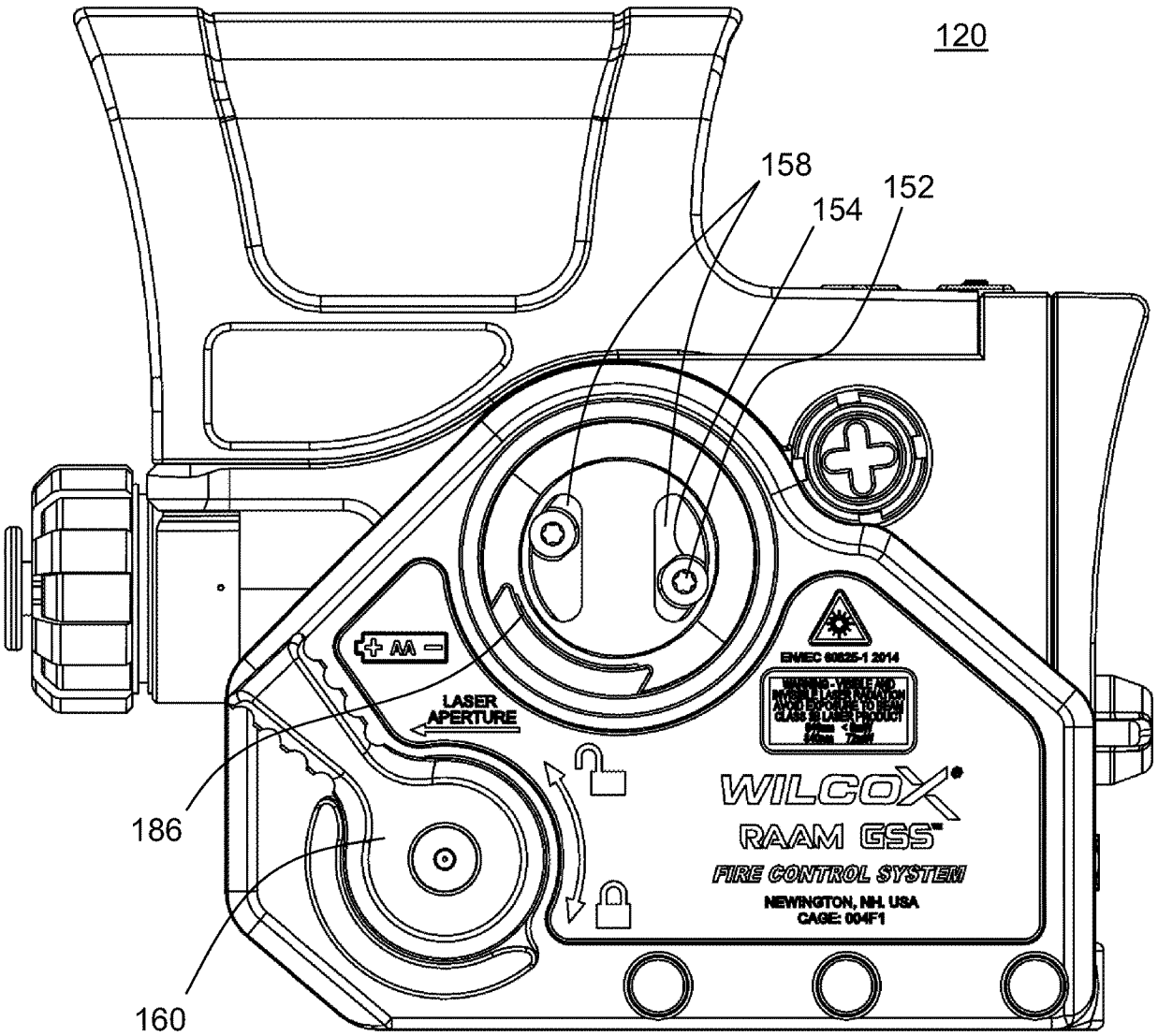
FIG. 9 is a left side elevational view of the fire control system appearing in FIG. 1, with the lock lever in the unlocked position.
Figure 10:
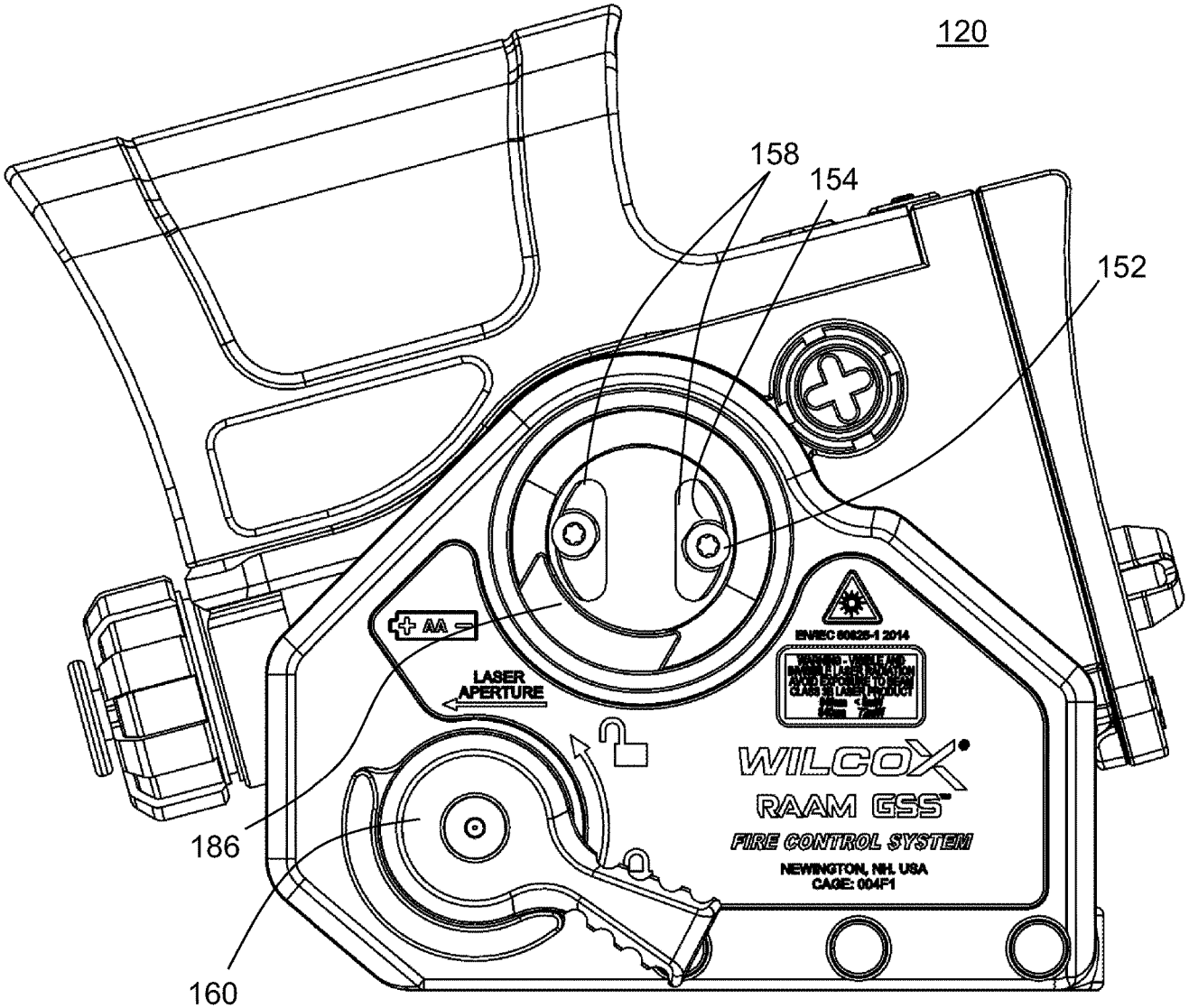
FIG. 10 is a left side elevational view of the fire control system appearing in FIG. 1, with the fire control system rotated for a 15 degree launch angle and the lock lever in the locked position.

In operation, when it is desired to manually pivot the main body 140, the lever 160 is pivoted to the unlocked position (see e.g., FIG. 9). When the lock lever 160 is pivoted to the unlocked position, the lock plate 170 is allowed to move out of engagement with the lock rotor 150. The main body 140 can then be rotated relative to the cradle arms 130R, 130L to set the desired trajectory angle of the grenade launcher apparatus 100. When it is desired to lock the main body 140 into a fixed position at the desired trajectory, the lever 160 is pivoted to the locked position (see e.g., FIGS. 8 and 10). When the lock lever 160 is pivoted to the locked position, the shoulder 184 follows the eccentric cam surface 176 to urge the distal edge 186 toward the lock plate 170 and exert a lateral force on the lock plate 170 to thereby resist rotation of the main body 140 with respect to the cradle arms 130R, 130L about the axis 146. Although the lever locking mechanism is illustrated as being disposed on the left cradle arm 130L is will be recognized that in alternative embodiments, the lever locking assembly may be disposed on the right cradle arm 130R.

The grenade launcher barrel assembly 112 includes a barrel 200 having a muzzle end 202 and a breech end 204. The barrel 200 defines a bore 205 having a series of alternating lands 206 and grooves 208 to impart spin to a projective fired by the grenade launcher unit 100. In embodiments, the barrel 200 is sized to accommodate 40 mm caliber grenades.

The barrel is secured to the receiver 112 via clamping ring and pivot assembly 210. The clamping ring and pivot assembly 210 has a clamping ring portion 212 and a hinge portion 214. The hinge portion 214 includes a lower hinge barrel 216 which is aligned with an upper hinge barrel 218 formed on the receiver 112. The upper and lower hinge barrels 218, 216 each contain a bore which are aligned along a barrel pivot axis 220 and receive a barrel hinge pin 222.

The ring clamp portion 212 includes split ring member 224 having a gap 226. A first lug 228 is rigidly attached to the split ring 224 at a positon above and adjacent the gap 226. The first lug 228 is also rigidly attached to the lower hinge barrel 216. A second lug 230 is attached to the split ring 224 at a position below and adjacent the gap 226 and opposes the first lug 228. The first lug 228 includes a clearance opening 232 receiving a threaded fastener 236, the clearance hole 232 being above and adjacent the gap 226. The second lug 230 includes a tapped opening 234 complementary with the threaded end of the fastener 236 wherein rotatably advancing the fastener 236 into the opening 234 draws the lugs 228 and 230 together and exerts a clamping action of the clamping ring 224 on the muzzle end 202 of the barrel 200. In this manner, the barrel 200 is pivotable about the barrel pivot axis 220 to open the breech of the grenade launcher and for loading, unloading, cartridge discharge, cleaning, etc.

The barrel is retained in the closed position via a latch assembly 240 disposed at the breech end of the barrel 204 of the barrel 200. The latch assembly 240 includes a rotatable knob 242 which controls a plunger 244. The plunger is selectively movable into and out of engagement with an opening 246 in a latch plate 248 disposed on the receiver 112 to secure and release, respectively, the breech end of the barrel. Although the barrel pivot assembly is illustrated as being disposed on the right side of the barrel axial centerline, is will be recognized that in alternative embodiments, the barrel pivot assembly may be disposed on the left side of the barrel axial centerline.

The shoulder stock or buttstock assembly 118 includes generally hollow portion 250 which telescopically receives a slide rod 252. The buttstock assembly 118 is capable of sliding back and forth to adjust a pull length of the grenade launcher 100. The length of pull is the distance between a trigger 254 and a recoil pad 256 disposed at a distal end of the buttstock assembly 118 and is adjustable to accommodate users of different sizes or body morphologies as well as pull length preferences based on shooting position (e.g., prone, crouching, kneeling, standing, etc.).

A rib or spline 258 is disposed on a lower surface of the slide rod 252 and is slidably received in a complementary groove or channel 260 in the butt stock assembly 118. The rib or spline 258 prevents rotation of the butt stock assembly 118 about the long axis of the slide rod 252.

In embodiments, retention features 262, such as a plurality of axially detent openings, gear teeth, or the like, are axially spaced along the spline 256. A retention member 264 in the channel 260 such as a complementary detent protrusion, pin, gear tooth, pawl, or the like, engages a selected one of the retention features 262 to secure the butt stock assembly 118 at a desired axial position on the slide rod 252. In embodiments, the retention member 264 is biased toward the retention features 262 and a buttstock slide release lever 266 is coupled to the retention member 264. The lever is pivotable to disengage the retention member 264 away from the retention features 262 to allow sliding movement of the butt stock assembly 118 with respect to the slide rod 252.

The grenade launcher trigger assembly 114 includes the trigger 254 and a trigger guard 270. In embodiments, the trigger assembly 114 includes a manual safety mechanism comprising a lever 272 movable between a safe position, wherein firing of the weapon is prevented, e.g., to prevent accidental discharge of the weapon, and a firing position. In certain embodiments, the trigger assembly 114 includes a mechanical firing mechanism comprising a mechanical linkage between the trigger and a hammer configured to strike a firing pin when the trigger is pulled. Alternatively, the trigger assembly 114 includes a firing mechanism selected from an electronic firing mechanism or an electro-mechanical firing mechanism.

The integrated fire control system 120 includes the main body 140 pivotally attached to the receiver mounting platform 122 via the left and right vertically extending cradle arms 130L, 130R. The main body 140 includes a housing 280 enclosing the internal components thereof. A front side 282 of the main body 140 is disposed opposite a rear side 284 thereof. A left side 286 of the main body 140 is disposed opposite a right side 288 thereof. Opposite upper and lower surfaces 290 and 292, respectively, are generally bounded by the generally vertically-extending front, rear, left, and right surfaces 282, 284, 286, and 288, respectively. In operation, the user views the rear side 284 of the unit 120. The front side 282 is opposite the rear side 284 and faces away from the user during operation, toward the selected target.

A display 294 is disposed on the rear side 284 of the main body 140. The display 294 may be an LCD display, LED display, or the like. In embodiments, the display 294 is a high-resolution display. In embodiments, the display 294 is an organic light-emitting diode (OLED) display. A rotary selector switch 296 is also disposed on the rear surface of the main body 140 for selecting an operational mode of the unit 120. The rotary select switch 296 is operable to select between a powered off state and one of a plurality of operational modes of the fire control system 120. In embodiments, an ammunition selector 298 switch is disposed on the rear surface 284 to allow the operator to select the grenade ammunition type.

The unit 100 includes a built-in ballistic computer and associated electronic memory (not shown) that provide a shooting solution for a target distance selected by the grenadier. In embodiments, the unit 120 is configured to allow the user to select a grenade ammunition type from a stored ballistic solution from the memory 316, e.g., via a menu interface navigated via the display 294 and keypad 300 or via the pre-programmed 2-position quick ammunition selector switch 298 to tailor the point of aim and point of impact for the selected ammunition. Additional ammunition types may be stored in the associated memory 316 of the processor 314 via a keypad 300 on the upper surface of the unit 120 comprising a plurality of user input keys or push buttons 300L, 300R, and 300C. In embodiments, the ammunition type and other operational parameters of the unit may be selected using a user interface such as a graphical and/or text or menu-based displayed on the display screen 294 which can be navigated using the input keys 300L, 300R, and 300C. In embodiments, the unit may comprise one or more environmental sensors or transducers for measuring one or more factors affecting the ballistic calculation, such as temperature, pressure, humidity, inclination, elevation, cant, heading, and the like.

Manually rotating the main body 140 sets the angle aiming references and causes a corresponding target distance to be displayed on the display screen 294 for the selected ammunition type. In operation, the user moves the lock lever 160 to the unlocked position and rotates the unit 140 about the pivot axis 146 until the display screen 294 displays the distance to the target. In embodiments, it is contemplated that the distance to the target is known, e.g., by measuring using a separate range finding apparatus or is otherwise calculated or estimated. The fire control unit 120 includes an integral reflex sight 302 which displays a dot, reticle, or the like for aligning with the target which can be transvisualized through the reflex sight to cause the barrel 200 of the unit 100 to be aligned at an appropriate trajectory angle to cause the path of a fired projectile to intersect with or near the position of the target in accordance with the ballistic solution. In certain embodiments, an integral or remotely range finder may be provided to determine a distance to a selected target.

In embodiments, the reflex sight 302 further comprises mechanical or iron sights, e.g., front and rear sights 304F, 304R, for daytime and/or backup use. In embodiments, one or more aiming and/or illuminating lasers are provided, including one or more visible lasers and/or infrared (IR) lasers. In certain embodiments, a near infrared (NIR) aiming laser and NIR illuminator are provided for use of the unit 100 in conjunction with a night vision viewing device.

The reflex sight 302 may be generally known in the art and typically include a battery-powered light source such as an LED or laser for projecting an illuminated reticle image, such as a dot, e.g., a red dot, or a projection display for projecting a reticle image. In embodiments, the reflex sight 302 includes a lens assembly (preferably but not limited to non-magnifying), employing a beam splitter, dichroic mirror, partially reflective coating, etc., that allows the user to view a target field of view therethrough while also reflecting light from the battery-powered light source along the viewing axis of the lens so that the viewer sees both the target field of view and projected reticle image superimposed thereon to aid the user in aiming the weapon.

A battery compartment 306 received a battery (not shown) for powering the unit 120. A releasable cap 308 is provided on the front surface 282 for loading and replacing the battery.

A windage adjustment 310 for bore sighting the unit 120 to the barrel 200 in the side-to-side direction is provided on the left side 286 of the main body 140. An elevation adjustment 312 for vertically bore sighting the unit 120 to the barrel 200 is provided on the upper surface 290 of the main body 140.

One or more laser emitters 314, 316, and 318 are mounted within the main body 140. In embodiments, the laser emitters are coaligned with each other on an optical bench (not shown) which, in turn is coaligned with the reflex sight 302. In certain embodiments, one of the laser emitters 314, 316, and 318 is an infrared (IR) illuminator (e.g., having a wavelength of 840 nm), another one of the laser emitters 314, 316, and 318 is an infrared (IR) aiming laser (e.g., having a wavelength of 840 nm), and another one of the laser emitters 314, 316, and 318 is a visible aiming laser (e.g., a red visible laser having a wavelength of 640 nm). In embodiments, the flood laser has a fixed flood width. Alternatively, focusing optics for the flood laser may be provided for selectively narrowing or broadening the flood beam. In embodiments, the IR flood and the IR aiming laser are operable individually, as well as together wherein a dot of higher intensity is visible within the flooded area when using night vision equipment.

Figure 11:
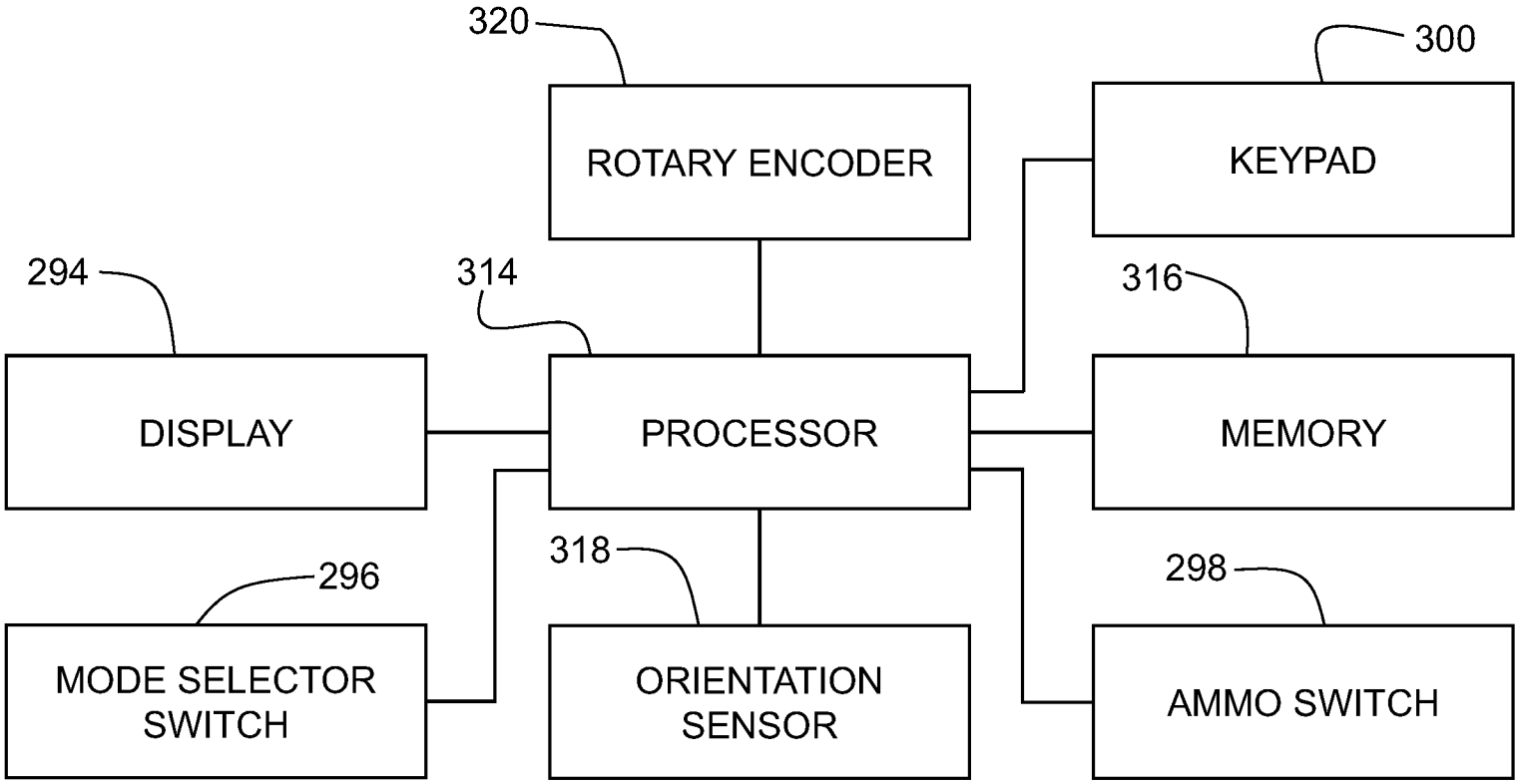
FIG. 11 is a block diagram illustrating an exemplary processing system of the fire control system herein.

Referring now to FIG. 11, the fire control system 120 includes rotary encoder 320 which is operable coupled to a processor 314 having an associated memory 316. The processor has a ballistic computation function or module. The rotary encoder tracks the rotational position of the main body with respect to the cradle arms 130R, 130L for the purpose of calculating a ballistic solution which is output to the display 294. Other sensors may be provided, such as an inclinometer or orientation sensor, which may be used to output a visual indication of weapon cant in the display 294. Likewise the state of the ammunition switch 298 is monitored and the ballistic parameters for other ammunition types may be stored in the memory 316. Still further sensors and/or data stored in the memory 316 may be provided for other ballistic factors such as temperature, atmospheric pressure, humidity, elevation, heading, wind speed and direction, and so forth.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A grenade launcher apparatus, comprising:

a receiver having a fore end portion;

a barrel pivotally attached to the fore end portion, the barrel having a muzzle end, a breech end, and a centerline extending therebetween;

a trigger assembly coupled to the receiver adjacent the breech end of the barrel;

a hand grip attached to the receiver adjacent the trigger assembly;

a buttstock assembly coupled to the receiver; and a fire control system secured to the fore end portion of the receiver, the fire control system comprising:

a first cradle arm and a second cradle arm opposing the first cradle arm, the first and second cradle arms attached to the fore end of the receiver on opposite transverse sides of the centerline;

a main body comprising at least one sight for aiming the grenade launcher apparatus, the main body manually rotatably supported between the first and second cradle arms, the main body pivotable about a pivot axis which extends perpendicular to the centerline;

a processor assembly including a processor and an associated computer readable memory encoded with executable instructions, the processor configured, upon execution of the executable instructions, to determine a trajectory angle corresponding to a rotational position of the main body in relation to the centerline and to calculate a distance that a projectile fired by the grenade launcher apparatus will travel;

a display configured to output said distance in human viewable form, said distance configured to change responsive to manual rotation of the main body;

the at least one sight configured to assist the user in aligning the grenade launcher apparatus with the trajectory angle by causing the grenade launcher apparatus to be aligned with the trajectory angle when an optical axis of the at least one sight is aligned with a target located at the calculated distance.

2. The grenade launcher apparatus of claim 1, wherein the fire control system is permanently secured to the fore end portion of the receiver.

3. The grenade launcher apparatus of claim 1, wherein the at least one sight includes a reflex sight.

4. The grenade launcher apparatus of claim 1, wherein the first cradle arm comprises a locking assembly, the locking assembly comprising:

a lock lever pivotable between an unlocked position wherein the main body is manually pivotable with respect to the first and second cradle arms and a locked position wherein the main body is prevented from pivoting with respect to the first and second cradle arms;

a lock rotor secured to the main body and aligned with the pivot axis;

a lock plate secured to the first cradle arm adjacent the lock rotor;

an actuator having a cam surface, the cam surface engaging a cam follower on the lock plate, the actuator attached to the lock lever wherein pivoting movement of the lock lever causes pivoting movement of the actuator;

wherein the cam surface is configured to urge the lock plate into engagement with the lock rotor when the lock lever is moved into the locked position to thereby prevent pivoting movement of the main body with respect to the first and second cradle arms; and wherein the cam surface is configured to allow the lock plate to move out of engagement with the lock rotor when the lock lever is moved into the unlocked position to thereby allow pivoting movement of the main body with respect to the first and second cradle arms.

5. The grenade launcher apparatus of claim 1, further comprising a ring clamp assembly pivotably securing the muzzle end of the barrel to the fore end of the receiver, the ring clamp assembly comprising:

a ring clamp having opposing first and second lugs;

a threaded fastener securing the first and second lugs;

a first hinge barrel secured to the first lug, the first hinge barrel having a first bore;

a second hinge barrel secured to the fore end of the receiver, the second hinge barrel having a second bore aligned with the first bore; and a barrel pivot pin received in the first and second bores, the first and second hinge barrels and the barrel pivot pin cooperating to form a barrel pivot hinge for selectively pivoting the breech end of the barrel toward and away from the receiver.

6. A fire control system for a projectile weapon, comprising:

a first cradle arm and a second cradle arm opposing the first cradle arm, the first and second cradle arms configured to be attached to the projectile weapon;

a main body comprising at least one sight for aiming the grenade launcher apparatus, the main body manually rotatably supported between the first and second cradle arms, the main body pivotable about a pivot axis which extends perpendicular to an axis of a barrel of the projectile weapon;

a processor assembly including a processor and an associated computer readable memory encoded with executable instructions, the processor configured, upon execution of the executable instructions, to determine a trajectory angle corresponding to a rotational position of the main body in relation to the axis of the barrel and to calculate a distance that a projectile fired by the grenade launcher apparatus will travel;

a display configured to output said distance in human viewable form, said distance configured to change responsive to manual rotation of the main body;

the at least one sight configured to assist the user in aligning the grenade launcher apparatus with the trajectory angle by causing the grenade launcher apparatus to be aligned with the trajectory angle when an optical axis of the at least one sight is aligned with a target located at the calculated distance;

a locking assembly disposed on the first cradle arm, the locking assembly comprising:

a lock lever pivotable between an unlocked position wherein the main body is manually pivotable with respect to the first and second cradle arms and a locked position wherein the main body is prevented from pivoting with respect to the first and second cradle arms;

a lock rotor secured to the main body and aligned with the pivot axis;

a lock plate secured to the first cradle arm adjacent the lock rotor;

an actuator having a cam surface, the cam surface engaging a cam follower on the lock plate, the actuator attached to the lock lever wherein pivoting movement of the lock lever causes pivoting movement of the actuator;

wherein the cam surface is configured to urge the lock plate into engagement with the lock rotor when the lock lever is moved into the locked position to thereby prevent pivoting movement of the main body with respect to the first and second cradle arms; and wherein the cam surface is configured to allow the lock plate to move out of engagement with the lock rotor when the lock lever is moved into the unlocked position to thereby allow pivoting movement of the main body with respect to the first and second cradle arms.

7. The fire control system of claim 6, wherein the at least one sight includes a reflex sight.

8. A method for aligning a barrel of a projectile weapon with a trajectory angle in relation to a line of sight between the projectile weapon and a target so that the projectile weapon will launch a projectile a distance that corresponds to a distance to the target, said method comprising:

providing a projectile weapon comprising a receiver having a fore end portion; a barrel pivotally attached to the fore end portion, the barrel having a muzzle end, a breech end, and a barrel axis; a trigger assembly coupled to the receiver adjacent the breech end of the barrel; a hand grip attached to the receiver adjacent the trigger assembly; and a buttstock assembly coupled to the receiver;

providing a fire control system secured to the fore end portion of the receiver, the fire control system comprising:

a first cradle arm and a second cradle arm opposing the first cradle arm, the first and second cradle arms spaced apart on opposing transverse sides of the barrel axis and attached to the projectile weapon;

a main body comprising at least one sight for aiming the projectile weapon, the main body manually rotatably supported between the first and second cradle arms, the main body pivotable about a pivot axis which extends perpendicular to the barrel axis;

a processor assembly including a processor and an associated computer readable memory encoded with executable instructions, the processor configured, upon execution of the executable instructions, to determine a trajectory angle corresponding to a rotational position of the main body in relation to the barrel axis and calculate a distance that a projectile fired by the projectile weapon will travel;

a display configured to output said distance in human viewable form, said distance configured to change responsive to manual rotation of the main body; and the at least one sight configured to assist the user in aligning the projectile weapon with the trajectory angle by causing the projectile weapon to be aligned with the trajectory angle when an optical axis of the at least one sight is aligned with a target located at the calculated distance;

rotating the main body about the pivot axis until the calculated distance output to the display is equal to a preselected target distance; and aligning the optical axis of the at least one sight with the target.

9. The method of claim 8, wherein the at least one sight includes a reflex sight.

10. The method of claim 8, wherein the projectile weapon is a grenade launcher.

11. A grenade launcher apparatus, comprising:

a receiver having a fore end portion;

a barrel pivotally attached to the fore end portion, the barrel having a muzzle end, a breech end, and a centerline extending therebetween;

a trigger assembly coupled to the receiver adjacent the breech end of the barrel;

a hand grip attached to the receiver adjacent the trigger assembly;

a buttstock assembly coupled to the receiver; and the fire control system of claim 6.

12. The grenade launcher apparatus of claim 11, wherein the fire control system is permanently secured to the fore end portion of the receiver.

13. The grenade launcher apparatus of claim 11, wherein the at least one sight includes a reflex sight.

14. The grenade launcher apparatus of claim 11, further comprising a ring clamp assembly pivotably securing the muzzle end of the barrel to the fore end of the receiver, the ring clamp assembly comprising:

a ring clamp having opposing first and second lugs;

a threaded fastener securing the first and second lugs;

a first hinge barrel secured to the first lug, the first hinge barrel having a first bore;

a second hinge barrel secured to the fore end of the receiver, the second hinge barrel having a second bore aligned with the first bore; and a barrel pivot pin received in the first and second bores, the first and second hinge barrels and the barrel pivot pin cooperating to form a barrel pivot hinge for selectively pivoting the breech end of the barrel toward and away from the receiver.

* * * * *